US011912528B2

(12) United States Patent
Chiusolo et al.

(10) Patent No.: US 11,912,528 B2
(45) Date of Patent: Feb. 27, 2024

(54) SPLICE HEAD FOR A SPLICER, SPLICE DEVICE HAVING AT LEAST ONE SPLICE HEAD, METHOD FOR SPLICING YARN USING A SPLICE HEAD, COMPUTER PROGRAM PRODUCT

(71) Applicant: Heberlein AG, Wattwil (CH)

(72) Inventors: Nicola Chiusolo, Flawil (CH); Christopher Bonk, Degersheim (CH); Lucas Ruoss, Wattwil (CH)

(73) Assignee: Heberlein Technology AG, Wattwil (CH)

( * ) Notice: Subject to any disclaimer, the term of this patent is extended or adjusted under 35 U.S.C. 154(b) by 126 days.

(21) Appl. No.: 17/608,883

(22) PCT Filed: Apr. 1, 2020

(86) PCT No.: PCT/EP2020/059251
§ 371 (c)(1),
(2) Date: Nov. 4, 2021

(87) PCT Pub. No.: WO2020/224874
PCT Pub. Date: Nov. 12, 2020

(65) Prior Publication Data

US 2022/0297973 A1 Sep. 22, 2022

(30) Foreign Application Priority Data

May 8, 2019 (EP) ..... 19173344

(51) Int. Cl.
*B65H 69/06* (2006.01)

(52) U.S. Cl.
CPC ..... *B65H 69/061* (2013.01); *B65H 2402/414* (2013.01); *B65H 2701/31* (2013.01)

(58) Field of Classification Search
CPC .... B65H 69/06; B65H 69/061; B65H 69/068; B65H 69/063; B65H 69/065; B65H 69/066; D07B 7/169; D01H 15/002
(Continued)

(56) References Cited

U.S. PATENT DOCUMENTS 3,070,947 A * 1/1963 De Toledo ..... B65H 69/02 57/22
4,361,003 A * 11/1982 Bertoli ..... B65H 69/061 57/22
(Continued)

FOREIGN PATENT DOCUMENTS

DE 31 14 790 A1 10/1982
DE 36 07 206 A1 9/1987
(Continued)

OTHER PUBLICATIONS

European Search Report Corresponding to 19173344.3 dated Feb. 25, 2020.
(Continued)

*Primary Examiner* — Shaun R Hurley
*Assistant Examiner* — Patrick J. Lynch
(74) *Attorney, Agent, or Firm* — Finch & Maloney PLLC

(57) ABSTRACT

A splicing head (100) for a splicing device comprising a splicing chamber and a clamping device (8) for clamping yarns. The clamping device (8) is disposed between two sections (4) of the splicing chamber. The clamping device (8) is arranged independently operable on the splicing head (100), so that the clamping device (8) is operable before and/or after closing the splicing chamber. The splicing head (100) comprises at least one drawing-in element for ensuring that the yarn ends are included in the splicing process, in particular for drawing the yarn ends into the splicing chamber.

19 Claims, 9 Drawing Sheets

Figure 1:
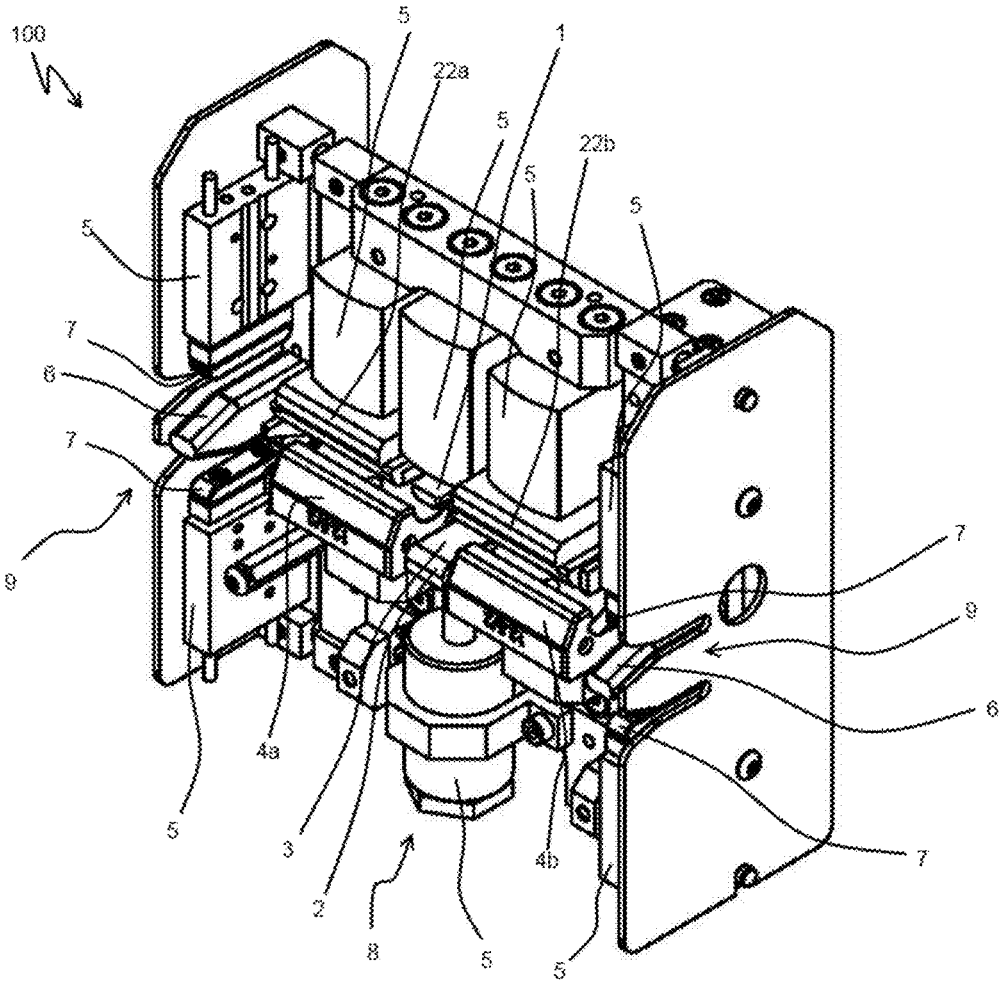

(58) Field of Classification Search
USPC ..... 57/22
See application file for complete search history.

(56) References Cited

U.S. PATENT DOCUMENTS 4,445,318 A 5/1984 Becker et al.
4,494,367 A * 1/1985 Badiali ..... B65H 69/06 57/22
4,738,093 A 4/1988 Zumfeld et al.
4,813,220 A * 3/1989 Isern ..... B65H 69/06 57/22
4,852,339 A * 8/1989 Premi ..... B65H 69/061 57/22
5,140,722 A * 8/1992 Akiyama ..... B65H 69/06 28/107
5,829,706 A * 11/1998 Schatton ..... B65H 69/063 57/22
2016/0145067 A1* 5/2016 Burchert ..... B65H 69/061 242/475.1
2016/0168786 A1* 6/2016 Bueno ..... D07B 1/18 57/22

FOREIGN PATENT DOCUMENTS

DE 42 26 025 A1 1/1993
EP 1 544 147 6/2005
EP 2 042 625 A1 4/2009
EP 2573025 A2 * 3/2013 ..... B65H 54/702

OTHER PUBLICATIONS

International Search Report Corresponding to PCT/EP2020/059251 dated Jul. 22, 2020.
Written Opinion Corresponding to PCT/EP2020/059251 dated Jul. 22, 2020.

* cited by examiner

SPLICE HEAD FOR A SPLICER, SPLICE DEVICE HAVING AT LEAST ONE SPLICE HEAD, METHOD FOR SPLICING YARN USING A SPLICE HEAD, COMPUTER PROGRAM PRODUCT

The invention relates to a splicing head for a splicing device, a splicing device with at least one splicing head, a method for splicing yarn with a splicing head and a computer program product.

Various splicing devices are known from the prior art. Splicing devices are commonly used for splicing threads, yarn or similar materials. In compressed air splicing devices, compressed air is applied to the yarn, particularly to the ends of the yarn, to swirl them, causing the filaments of the yarns to open and intertwine. This makes it easy to join yarns together. It is particularly important for a clean connection between the yarns that the ends of the yarns are well spliced, otherwise they can get caught on eyelets.

A two-part device for splicing is known from DE 42 260 25. The lower part of the splicing device comprises two fluid feeds and a cavity in which an elastic clamping element is arranged. A disadvantage of this device is that the yarn ends are not well spliced.

It is the task of the invention to remedy these and other disadvantages of the prior art and, in particular, to provide a splicing head, a splicing device with splicing heads and a computer program product which ensure that yarn ends are well bound by the splicing process.

According to the invention, these tasks are solved by a splicing head for a splicing device, a splicing device with at least one splicing head, a method for splicing yarn with a splicing head and a computer program product according to the independent claims.

In particular, the problem is solved by a splicing head for a splicing device comprising a splicing chamber and a clamping device for clamping yarns. The clamping device is arranged between two sections of the splicing chamber. The clamping device is independently operably disposed on the splicing head, such that the clamping device is operable before or after closing the splicing chamber. The splicing head comprises at least one drawing-in element for ensuring that the yarn ends are arranged in the splicing chamber, in particular for drawing the yarn ends into the splicing chamber.

One problem in ensuring that the yarn ends can be spliced well is that the yarn ends are often somewhat longer or approximately the same length as the splicing chamber after they have been cut off, and are therefore not completely arranged in the splicing chamber. This means that they are not sufficiently exposed to the splicing medium, for example compressed air or water jets. The drawing-in element can ensure that the yarn ends are retightened and are completely in the splicing chamber after readjustment. This makes it easier to splice the yarn ends.

Preferably, the drawing-in element is designed in such a way that the distance from an entrance of the yarn into a splicing chamber to a clamping element of a clamping device can be extended and/or lengthened. This can be achieved, in particular, by guiding the yarn over a surface or over a body or by displacing or extending the splicing chamber in the direction of the entrance for the yarn.

For this purpose, the feed element may be movable in the splicing chamber so that the yarn can be brought into a curved configuration by impacting it with a surface of the element, thereby providing a longer path from the entrance of the yarn to the clamping element. Alternatively, the splicing chamber may be slidable. Further alternatively, at least one cutting element may be arranged within a splicing chamber, preferably in a splicing chamber section, in particular in a wall of a splicing chamber or splicing chamber section.

Further alternatively, the splicing chamber can be designed to be extendable and/or displaceable, in particular the splicing chamber can comprise splicing chamber sections, wherein the splicing chamber sections are displaceable in yarn guiding direction in such a way that at least one yarn end is completely located in the splicing chamber section.

The yarn guiding direction is the direction along which the yarn is inserted into the splicing head.

Preferably, the splicing head comprises further, in particular two further, clamping devices. The clamping devices are preferably arranged upstream and downstream of the splicing chamber sections in the yarn guiding direction. In particular, at least one of the further clamping devices is arranged pivotably and/or displaceably on the splicing head, preferably displaceably in yarn guiding direction, in particular preferably the drawing-in device is part of the further clamping devices.

In this way, the yarns can be easily clamped, which simplifies the cutting of the yarns. The clamping devices can be designed in such a way that in each case only one yarn can be clamped individually or both individually and/or both together. In particular, the clamping devices may each comprise at least two, preferably three, clamping elements. The clamping device may comprise two single-sided clamping elements and one versatile clamping element. A single-sided clamping element has a single clamping surface. A versatile clamping element has more than one clamping surface. In particular, the single-sided clamping elements may be arranged on the splicing head to enable clamping with a respective face of a versatile clamping element.

The at least one drawing-in element may be part of the clamping device and/or at least one drawing-in element may be an element independent of the clamping device. If at least one drawing-in element is part of the clamping device, a simple construction of the splicing head is enabled. If at least one drawing-in element is an element independent of the clamping device, the drawing-in can be adjusted independently of the clamping device.

Each splicing chamber sections may include at least one nozzle for introducing a fluid, in particular compressed air and/or water jet. The splicing head may include at least one fluid supply, and in particular the nozzles of both splicing chamber sections may be connected and/or connectable to the same fluid supply.

The splicing chamber sections may be formed as separate chambers and/or as a part of a larger splicing chamber.

All kinds of threads, yarns, cables or similar materials can be spliced through such a splicing head. These may consist of artificial fibers (plastics such as PE, PP, etc.), natural fibers (cotton, wool, raffia, etc.) or mixed fibers. Particularly advantageously, the splicing head according to the invention is suitable for splicing filaments with large diameters, especially those made of aramid, carbon or glass. These materials may comprise monofilaments or multifilaments. Herein, the term "yarn" is used to refer to all of these types of spliceable materials.

Preferably, the splicing head comprises two cutting elements for cutting the yarns. In particular, the cutting elements are arranged in yarn guiding direction before the first and after the second section of the splicing chamber.

The cutting elements allow yarn ends to be easily removed.

Preferably, the clamping device comprises a first clamping element and a second clamping element. The clamping elements comprise clamping surfaces. The clamping device defines a distance between the clamping surfaces in an open position, so that a tension can be applied to the yarns when clamping the yarn. In particular, the spacing is such that the yarn ends are retractable by at least 5% and preferably at least 10% of the length of the splicing chamber.

This allows a simple construction of the clamping device. In an embodiment in which the at least one drawing-in element is part of the clamping device, the clamping device may comprise at least one, preferably two, extending elements. In particular, the clamping device may comprise pneumatic and/or hydraulic cylinders. In particular, a clamping device may comprise three positions: an open position, a closed position, and a retract position. In the open position, the yarns are not clamped by the clamping device. In the open position, the first or second clamping member may be in an extended position. In a closed position, the yarns are clamped between the clamping elements. In the closed position, both clamping elements can be in an extended position, in particular one clamping element can be in a semi-extended position. In a retracted position, the yarn ends are retracted into the splicing chambers. In the retracted position, one clamping element may be in a retracted position and the other may be in a fully extended position, in particular. Alternatively, the clamping device may be tilted and/or pivoted in the retracted position. In particular, the clamping surfaces are arranged parallel to the yarn guiding direction. Alternatively, the clamping surfaces may be arranged at an angle to the yarn guiding device, in particular such that closing the clamping device allows the yarn ends to be drawn in. In this alternative embodiment, the clamping device comprises only two positions, one open and one closed.

Preferably, the clamping surfaces comprise rough and/or adhesive surfaces for preventing sliding of the yarns. In particular, a clamping surface made of silicone is used as the adhesive surface. Due to the resilience of silicone, a good clamping effect is obtained. This can be a coating or the body with the clamping surface is made in one piece from silicone.

Preferably, the clamping device comprises pneumatic and/or hydraulic and/or electronic movement elements for actuating at least one clamping element.

This enables easy automatic actuation of the clamping device. The splicing head may be connected and/or connectable to a control device for controlling the splicing process. Alternatively, the clamping device can be actuated mechanically, in particular by a user via a lever. Electronic motion elements may include a motor. The control device may comprise a computing unit. The control device may be pneumatic and/or hydraulic.

Preferably, the splicing chamber is movably arranged on the splicing head so that chamber openings can be closed in a second position of the splicing chamber and/or the splicing chamber comprises a closing device for closing the splicing chamber.

Thus, an escape of the yarn ends can be easily prevented. The closing device may comprise lids, flaps or other closing elements. The closing device may be connected or connectable to a control device. The closing device may be connected and/or connectable to a moving element, in particular to a moving element of the clamping device. The splicing head may comprise additional pneumatic and/or hydraulic and/or electronic moving elements for actuating other elements such as the splicing chamber and/or the closing device.

The splicing head may be manufacturable in various sizes. Thus, small and large yarns can be spliced.

The splicing head may comprise fastening elements for fastening a housing and/or for fastening to a splicing device. The splicing head may include a housing.

Thus, various elements may be easily attached to the splicing head or the splicing head may be easily attached to other elements.

The splicing head may include yarn guide elements for securely guiding yarns. The yarn guide elements may include curves.

This may ensure that yarns are not damaged during insertion, feed-through and feed-out.

The task is further solved by a splicing device comprising at least one splicing head as previously described. In particular, the splicing device may comprise a plurality of splicing heads. These splicing heads are arranged in series, so that several parallel yarns can be spliced separately by the splicing device.

In particular, the splicing device comprises a rake unit. This is typically a programmable logic controller (PLC). In principle, however, any type of computer-based control system using integrated processors or commercially available computers or controllers is conceivable.

The computing unit may be connected and/or connectable to a control device (in particular a pneumatic island) for controlling the splicing process. The computing unit may be part of a yarn processing machine and/or system. "In-line" as used herein means lined up end to end, with the fade guides of the splicing heads arranged substantially parallel. "Separate" as used herein means that one splicing head splices different yarns than another splicing head. The splicing head may be rotatably connected and/or connectable to the splicing device such that the rotational movement allows the yarn ends to be drawn into the splicing chambers.

The splicing device may include a splicing medium source, such as a source of compressed air, with which the at least one splicing head may be in fluid communication. In an embodiment with multiple splicing heads, all splicing heads may be connected and/or connectable to the same or different splicing medium sources.

The splicing heads may be connected or connectable to the same fluid supply. The splicing heads may be individually and/or separately controlled or controllable.

Further, the task is solved by a method for splicing yarn in particular with a splicing head as described above. The method comprises the steps introducing yarns to be spliced clamping of the yarns to be spliced Actuating a drawing-in element (8; 31; 32) in such a way that the yarn ends are arranged inside the splicing chamber, in particular for drawing the yarn ends into the splicing chamber, splicing the yarn ends.

Such a method allows easy and tight splicing of the yarn ends. The insertion of the yarns to be spliced can take place by inserting the yarns through an insertion mechanism and/or by guiding the splicing head to the yarns. The insertion of the yarn ends can be controlled selectively.

The device according to the invention also enables a presplicing to be carried out. In an advantageous further development of the method according to the invention, therefore, an excess of yarn is generated between clamping points of the yarn in the clamping device before or after the yarns to be spliced are clamped by the clamping device. In this configuration, a pre-splice is made. The excess of yarn (a yarn reservoir, so to speak) allows splicing even if the yarn is fixed between the clamping points. Then the yarn ends are cut and the drawing-in elements are actuated in the manner explained previously. As a result, the yarn ends are drawn into the splicing chamber and the actual splicing can be performed. Various possibilities exist for generating the excess, in particular the actuation of the drawing-in elements described above.

The task is further solved by a computer program product. The computer program product is directly loadable into the internal memory of a computer. The computer program product comprises a software component for executing the actuation of the drawing-in element and/or the splicing in a method for splicing yarns as previously described.

Such a computer program product enables a splicing operation to be performed easily, quickly and safely.

One embodiment of a preferred splicing head is explained by way of example with reference to the following figures.

They show:

FIG. 1: Perspective view of a splicing head.

Figure 2:
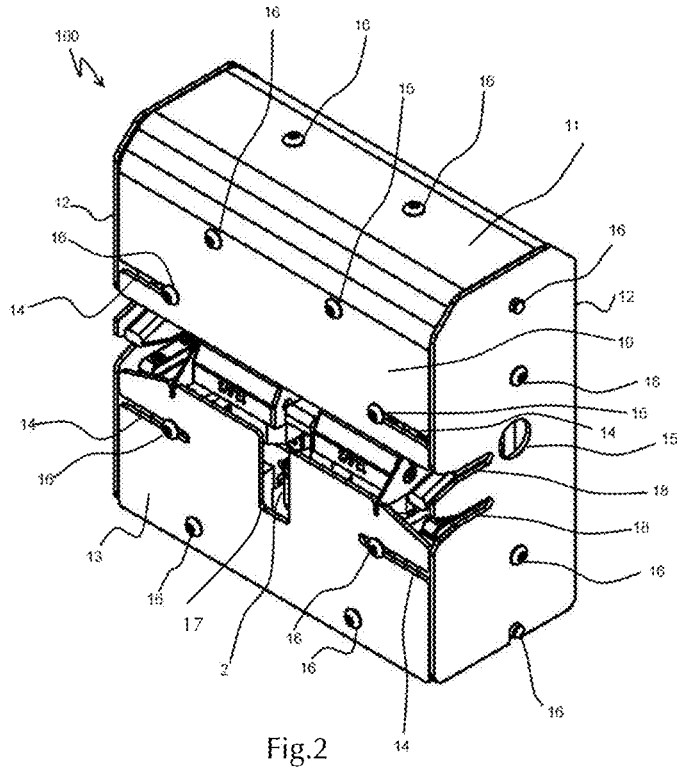

FIG. 2: Perspective view of the splicing head with housing

Figure 3:
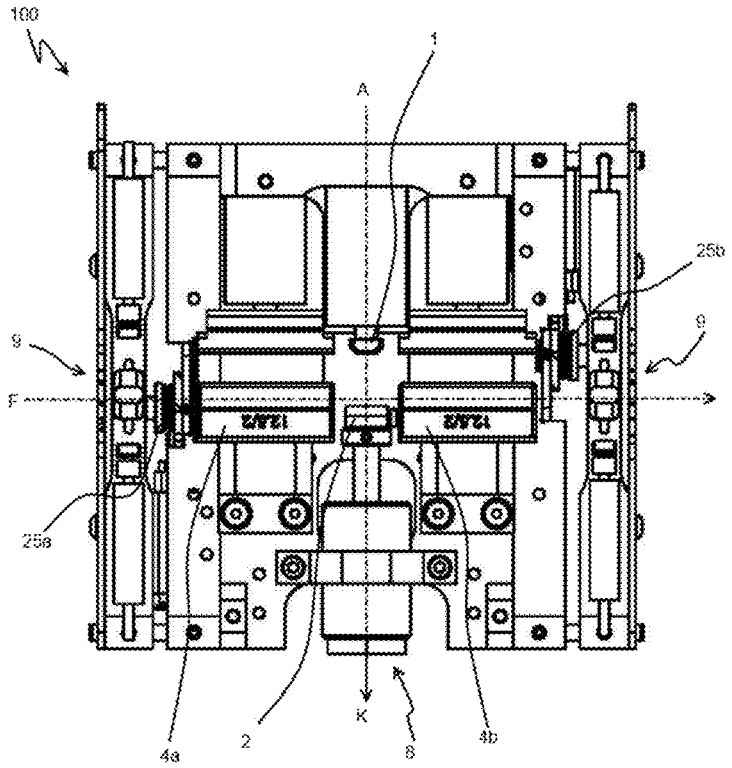

FIG. 3: Front view of the splicing head

Figure 4:
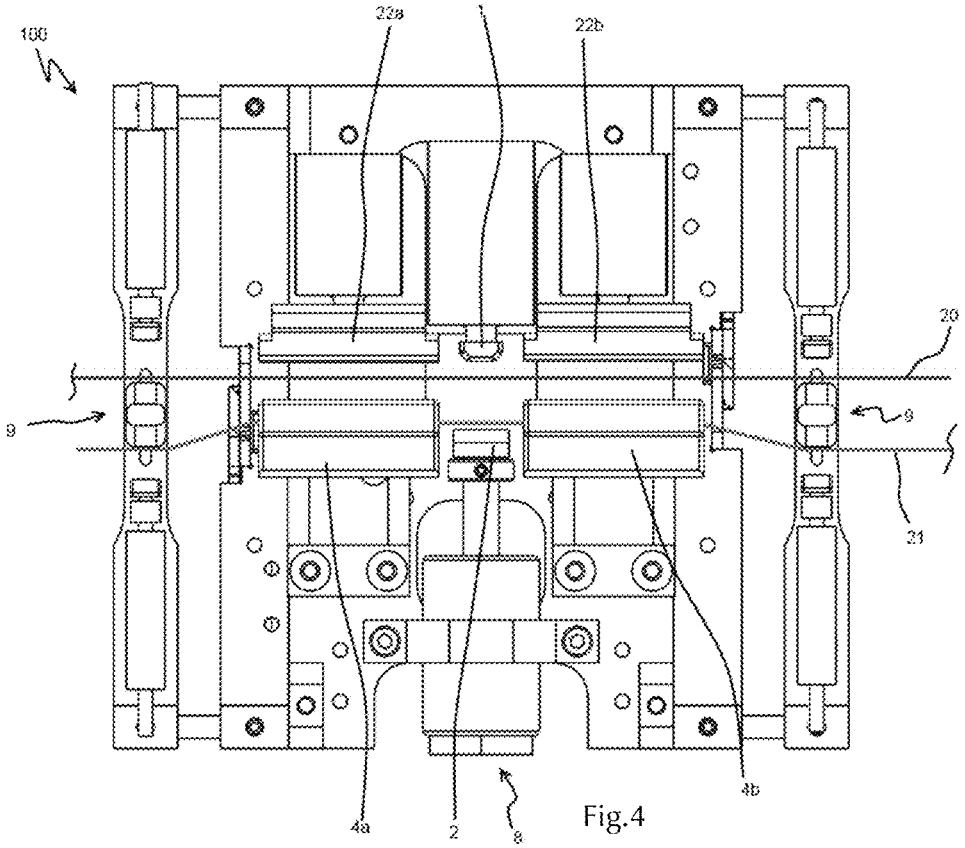

FIG. 4: Front view of the splicing head at the beginning of the splicing process FIG. 5: Front view of splicing head with closed splicing chambers FIG. 6: Front view of the splicing head with cut yarn FIG. 7: Front view of splicing head with pulled-in yarn ends FIG. 8: Front view of the splicing head with cut yarn with an alternative design of the drawing-in element FIG. 9: Front view of splicing head with displaced splicing chamber sections FIG. 10: Front view of the splicing head with cut yarn with a third embodiment of the feed element FIG. 11: Front view of the splicing head with displaced lateral clamping devices FIG. 12: Schematic view of a splicing device with calculating unit and

13*a* to 13*c*: Various work steps in a process in which presplicing is performed.

FIG. 1 shows a perspective view of a splicing head 100. The splicing head 100 comprises two splicing chamber sections 4*a* and 4*b*, a central clamping device 8 and two lateral clamping devices 9.

Each splicing chamber sections 4*a,b* includes a cover 22*a,b* and a nozzle (not shown here).

The central clamping device 8 comprises a first clamping element 1 and a second, opposite clamping element 2. The clamping elements 1 and 2 each have a clamping surface 3 (only the clamping surface 3 of clamping element 2 is shown here) between which yarns are clamped (cf. FIG. 5).

The lateral clamping devices 9 each comprise two single-sided clamping elements 7 and one double-sided clamping element 6. The double-sided clamping element 6 is arranged between the single-sided clamping elements 7 and comprises two clamping surfaces. Each clamping surface of the double-sided clamping element 6 is associated with a single-sided clamping element 7.

The splicing head 100 comprises eight moving elements 5, in this case pneumatic cylinders. In each case, a movement element 5 is connected to a clamping element 1, 2 and 7 or to a cover 22.

Figure 6:
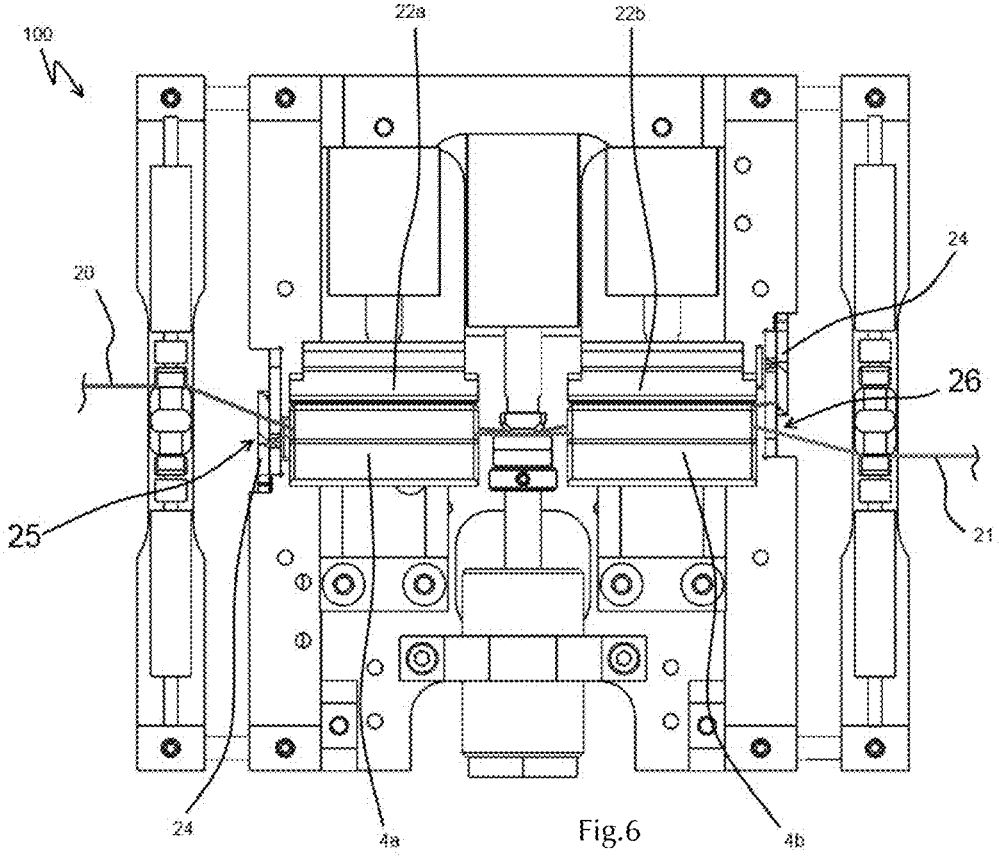

Furthermore, the splicing head 100 comprises two cutting elements 24 (see FIG. 6.

The splicing head 100 is used for splicing, i.e. joining, yarns. For this purpose, the yarns to be spliced are inserted into the splicing head 100, clamped by the central clamping device 8 and the lateral clamping devices 9 and cut by the cutting elements 24*a,b* (cf. FIG. 6). The splicing chamber sections 4*a,b* are closed by the covers 22*a,b*. The central clamping device 8 then moves transversely to the yarn guiding direction (cf. FIG. 3) and pulls the yarns to be spliced along, so that the yarn ends are drawn into the splicing chamber sections 4*a,b*. Typically, the clamping device 8 moves to such an extent that the yarn ends are drawn in by more than 10% of the length of the splicing chamber. A fluid, in this case compressed air, is introduced into each splicing chamber section 4*a, b* via a nozzle, causing the filaments of the yarns to open and become intertwined. The center clamping device 8, the side clamping devices 9 and the covers 22*a,b* are then opened. For details of the splicing process, reference is made here to FIGS. 4-7.

FIG. 2 shows the splicing head 100 in perspective view. The splicing head 100 includes a housing 10 having a first housing plate 11, a second housing plate 13, and two side plates 12. The first housing plate 11 includes two mounting slots 14. The second housing plate 13 also includes two mounting slots 14 and a clamping element opening 17 that allows a view of the second clamping element 2. Further seen is a circular side opening 15 and two yarn guide openings 18, here formed as slots, in a side plate 12. The side opening 15 is used to pass a tool (typically a screwdriver) for fastening screws (not shown) of the cutting elements 24. The side plate 12 further has two chamfered corners and two rounded corners. Both side plates 12 are identical.

Further, the splicing head 100 includes four fasteners 16 for each housing plate 11, 12 and 13.

FIG. 3 shows the splicing head 100 in a front view. The clamping device 8 is arranged in the center of the splicing head 100, so that the clamping direction K leads along a center plane A. The yarn guiding direction F leads at a right angle to the center plane A. In the yarn guiding direction F, first lateral clamping elements 9 are arranged first, followed by a first cutting element 24, a first splicing chamber section 4*a,b* and the clamping device 8. The splicing head 100 is constructed in mirror symmetry to the center axis A, so that the same elements of the splicing head follow in the yarn guiding direction F in reverse order.

On the basis of the following figures, a splicing process with a splicing head 100 is described.

FIG. 4 shows the splicing head 100 in front view at the beginning of the splicing process. The clamping device 8, the covers 22 of the splicing chamber sections 4*a,b* and the lateral clamping elements 9 are in the open position. In the open position, the first clamping element 1 is in the retracted position, so the pneumatic cylinder 5*a* is fully inside its envelope, the second clamping element 2 is in the extended position, so the pneumatic cylinder 5*b* is substantially outside its envelope. The covers 22*a,b* are in the retracted position.

At the beginning of the splicing process, the yarns 20 and 21 are inserted into the splicing head 100, respectively the splicing head 100 is moved towards the yarns 20 and 21, so that they are guided from one end of the splicing head 100 along the yarn guiding direction to the other end of the splicing head 100.

Figure 5:
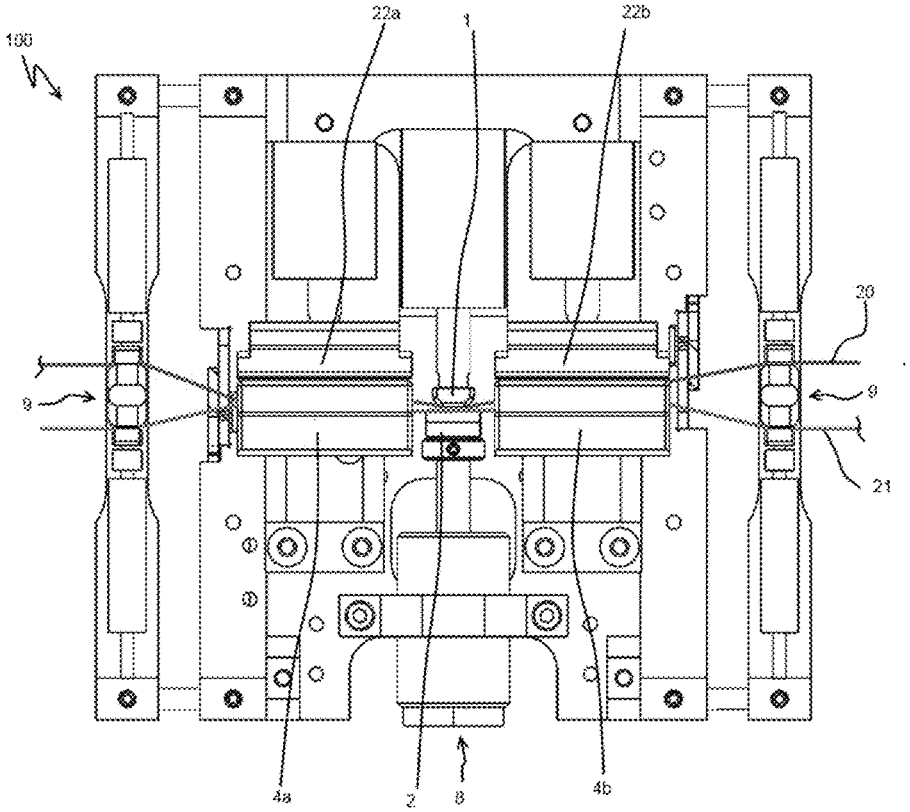

FIG. 5 shows the splicing head 100 in front view with closed splicing chambers 4*a,b*. The covers 22 can be seen in the extended position, thus closing the splicing chambers 4*a,b*. In addition, the side clamping devices 9 and the center clamping device 8 are closed so that the yarns 20 and 21 are clamped. In this case, the yarns 20 and 21 are clamped individually by the side clamping devices 9, and both yarns are clamped together by the middle clamping device 8. The clamping elements 1 and 2 are thus in a closed position: clamping element 1 is partially extended, clamping element 2 is fully extended.

FIG. 6 shows the splicing head 100 in front view with cut yarns 20 and 21. After closing the chamber sections 4 by the covers 22 and clamping the yarns 20, 21, the yarns are cut. In this process, the first yarn 20 is cut at a first end 25 of a first splicing chamber section 4 and the second yarn 21 is cut at a second end 26 of a second splicing chamber section 4*a,b* by the cutting elements 24*a,b*.

Figure 7:
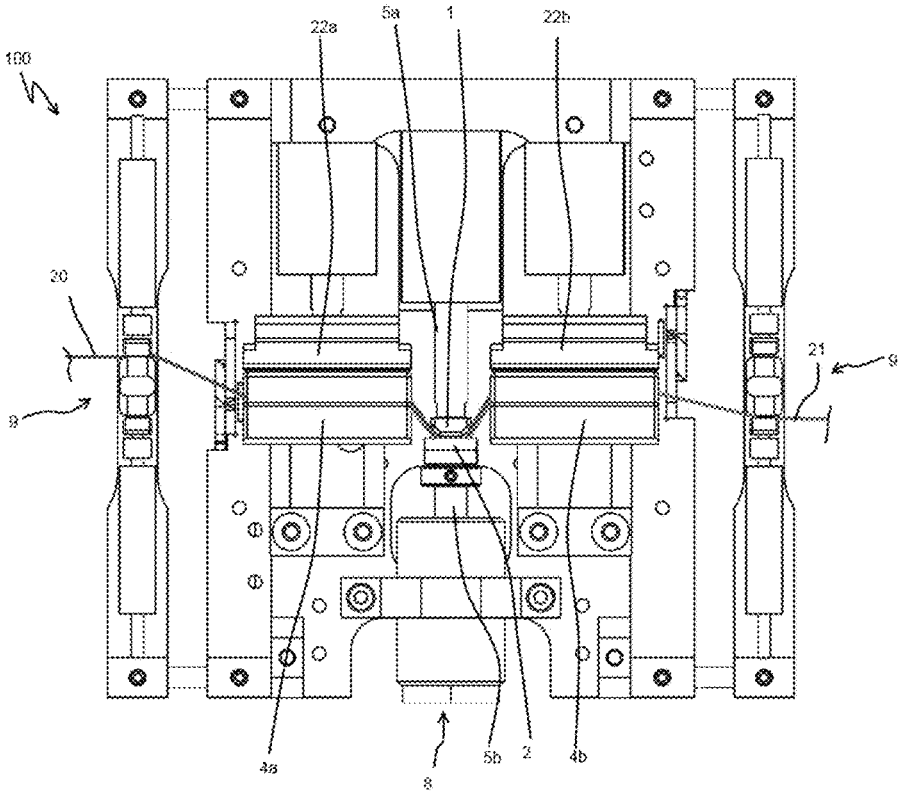

FIG. 7 shows the splicing head 100 in front view with yarns 20 and 21 drawn into the splicing chamber sections 4. Here, the clamping device 8 can be seen in the drawing-in position in which the yarn ends are drawn into the splicing chamber sections 4. Here, the first clamping element 1 is in the fully extended position, and the second clamping element 2 is in the retracted position.

After cutting, the clamping device 8 moves from the closed position to the retracted position, pulling the ends of the yarns 20 and 21 into the splicing chamber sections 4*a,b*.

After the step according to the illustration shown in FIG. 7, the clamping device 8 is moved back again. Now a splicing operation can be carried out in a manner known per se.

The yarns 20 and 21 can now be spliced together by introducing a splicing medium such as water or compressed air into the splicing chamber sections 4. When the splicing operation is complete, the covers 22*a,b*, the center clamping device 8 and the side clamping devices 9 are opened and the spliced yarn can be removed.

In the following FIGS. 8-11, alternative embodiments of the splicing head 100 are described. Only the differences of the splicing head 100 and the splicing process are described in comparison to the embodiment from the previous figures.

Figure 8:
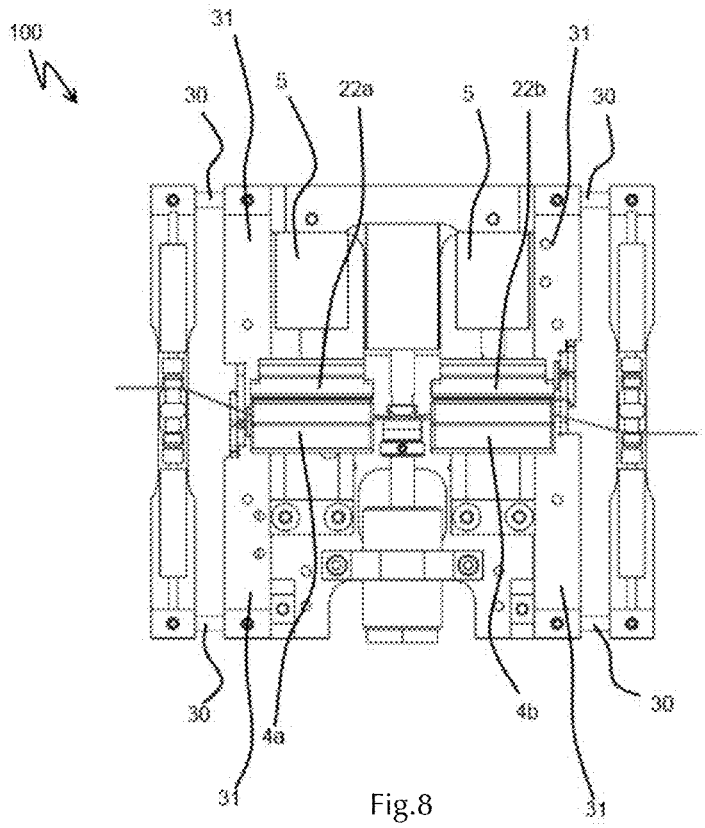

FIG. 8 shows a front view of the splicing head 100 with cut yarn with an alternative embodiment of the drawing-in element. Here, the splicing head 100 comprises four guide elements 30 for guiding chamber moving elements 31 and four chamber moving elements 31. The chamber moving elements 31 allow the splicing chamber sections 4*a* and 4*b* to be moved in and against the yarn guiding direction (cf. FIG. 9). The splicing chamber sections 4*a* and 4*b* are in their starting position directly next to the central clamping device 9.

Figure 9:
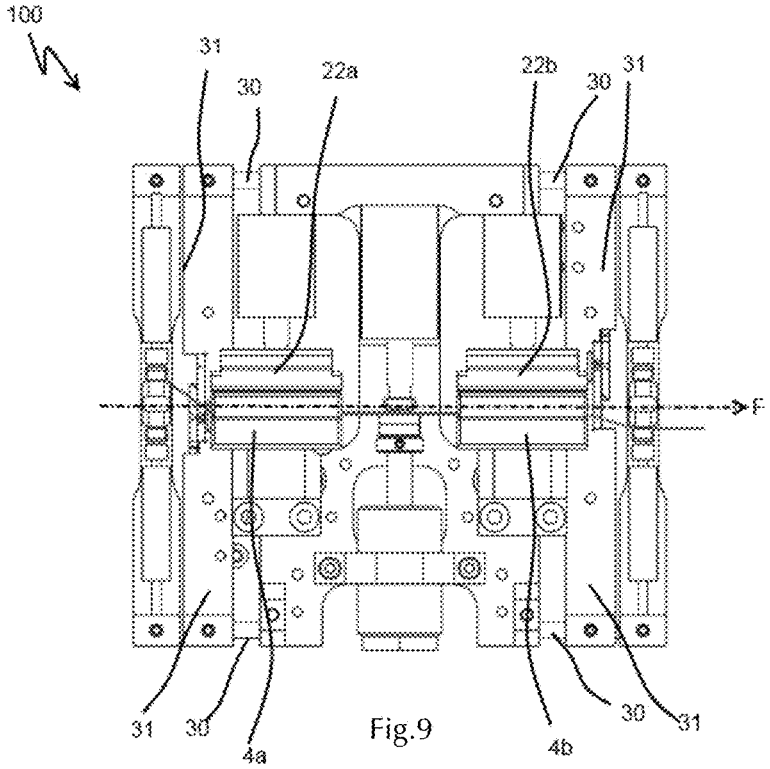

FIG. 9 shows a front view of the splicing head 100 with displaced splicing chamber sections 4*a* and 4*b*. The chamber moving members 31 have moved the splicing chamber section 4*a* against the yarn guiding direction and the splicing chamber section 4*b* in the yarn guiding direction, so that the yarn ends are inside the splicing chamber sections 4*a* and 4*b*. The splicing operation can be performed normally. Before starting a new splicing operation, the splicing chamber sections 4*a* and 4*b* are returned to their initial position (cf. FIG. 8).

Figure 10:
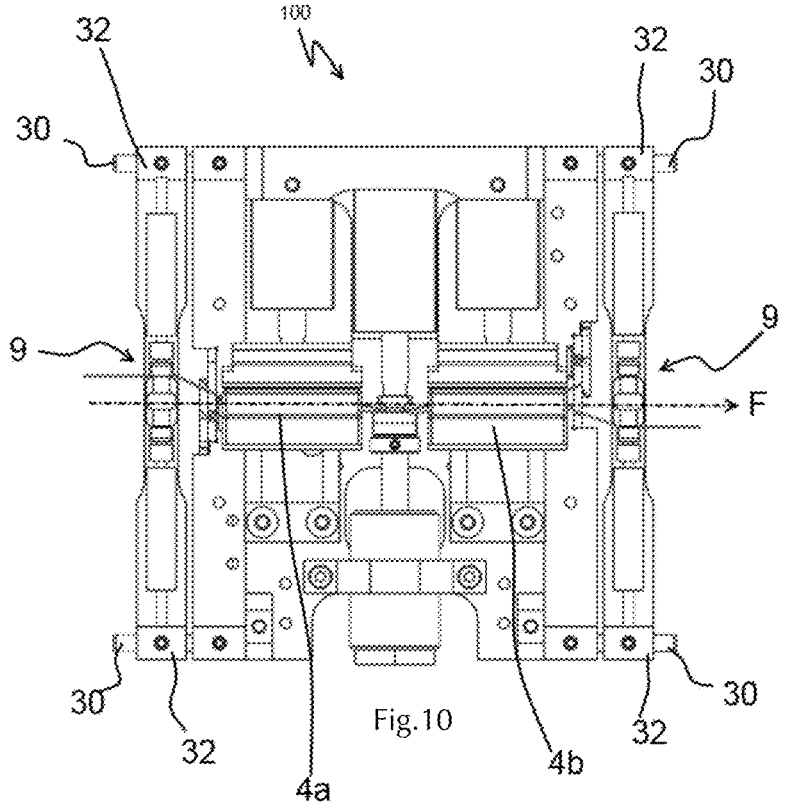

FIG. 10 shows a front view of the splicing head 100 with cut yarn with a further embodiment of the pull-in element. Here, the splicing head 100 also comprises four guiding elements 30. These guiding elements 30 serve here to enable the movement of the lateral clamping devices 9 in and against the yarn guiding direction. Further, the splicing head 100 comprises displacement elements 32 which allow the lateral clamping devices 9 to be displaced. Here, the lateral clamping devices 9 are in their initial position directly adjacent to the splicing chamber sections 4*a* and 4*b*.

Figure 11:
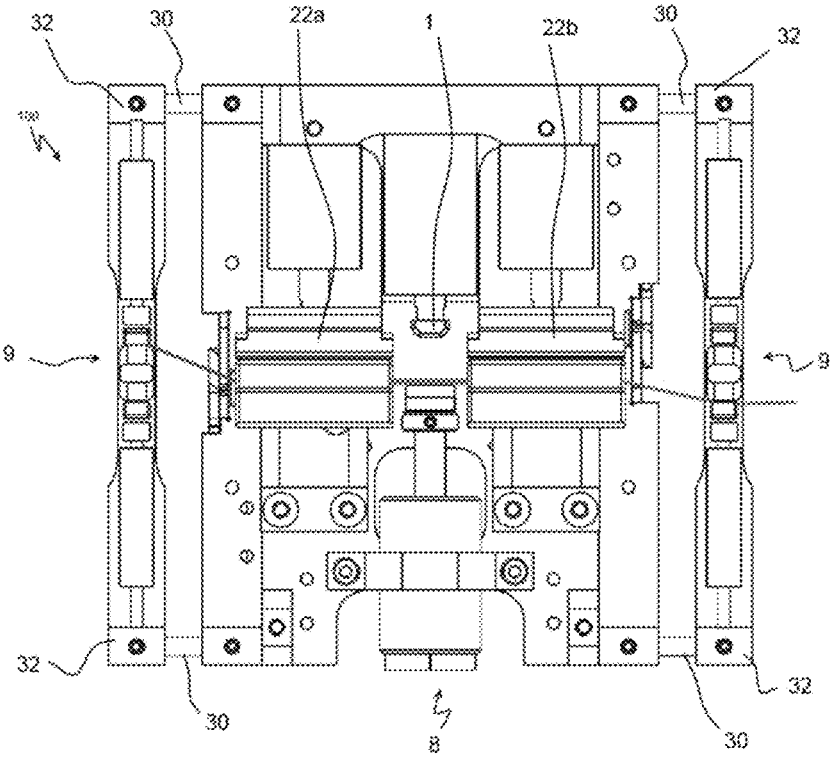

FIG. 11 shows a front view of the splicing head 100 with displaced lateral clamping devices 9. The central clamping device 8 is opened before the lateral clamping devices 9 are displaced. By shifting the clamping devices 9, the yarn ends are pulled into the splicing chamber sections 4*a* and 4*b*. After that, the splicing process can be continued normally. Before a further splicing operation, the lateral clamping devices 9 are returned to their initial position (see FIG. 10).

Figure 12:
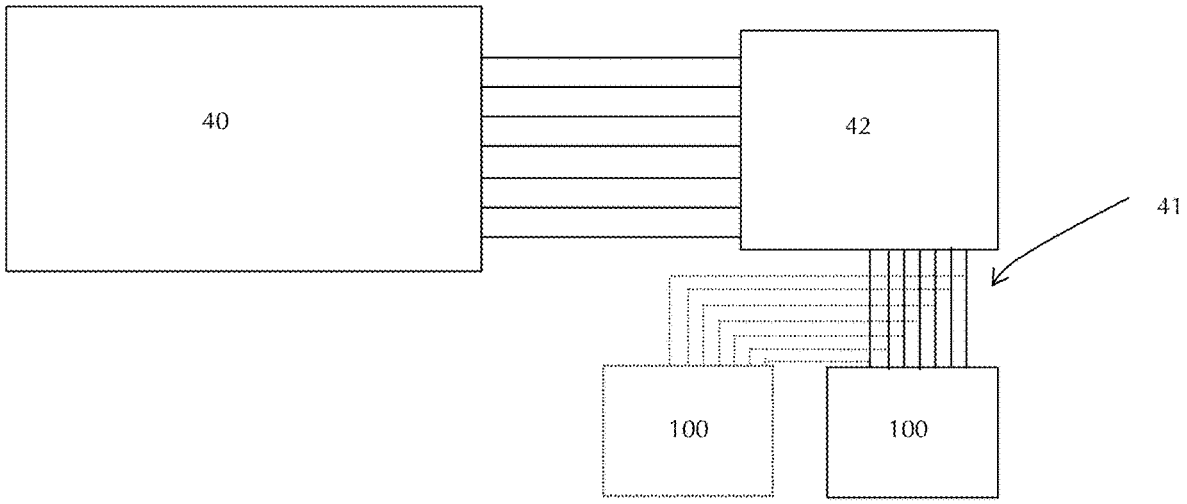

FIG. 12 shows a schematic representation of a splicing device 41 with a PLC 40. The splicing device 41 comprises several splicing heads 100 in series, which splice different yarns. The PLC 40 controls the splicing process by controlling a pneumatic island 42, which feeds several splicing heads arranged parallel to each other. As an alternative to the illustration in FIG. 12, a PLC can also control a plurality of pneumatic islands, each feeding a splicing head.

Figure 13A:
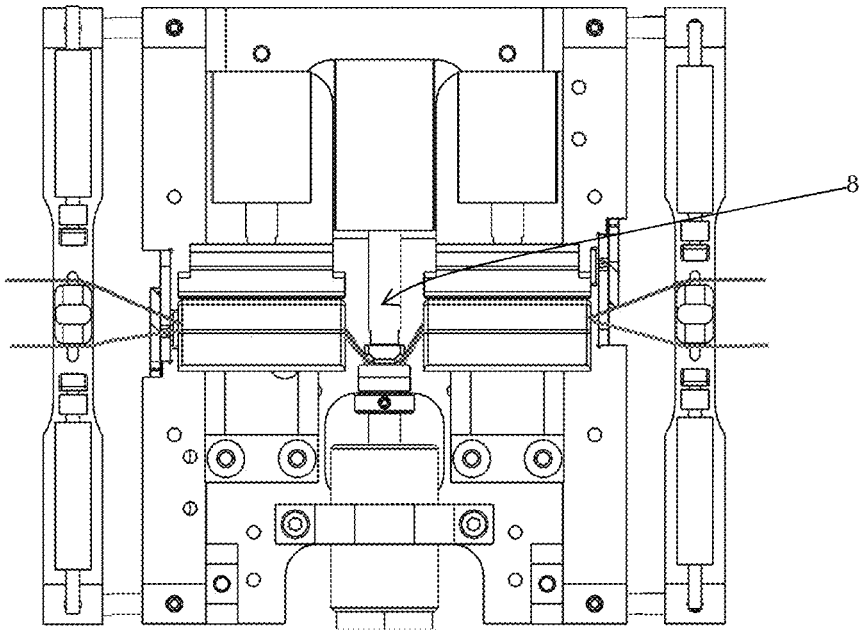
Figure 13B:
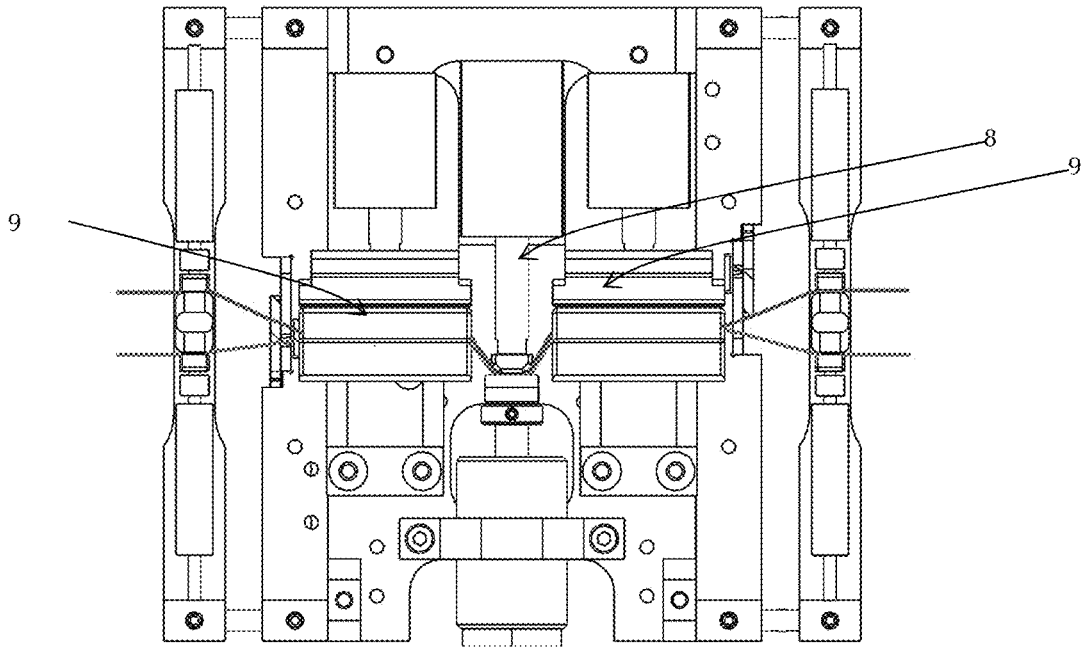
Figure 13C:
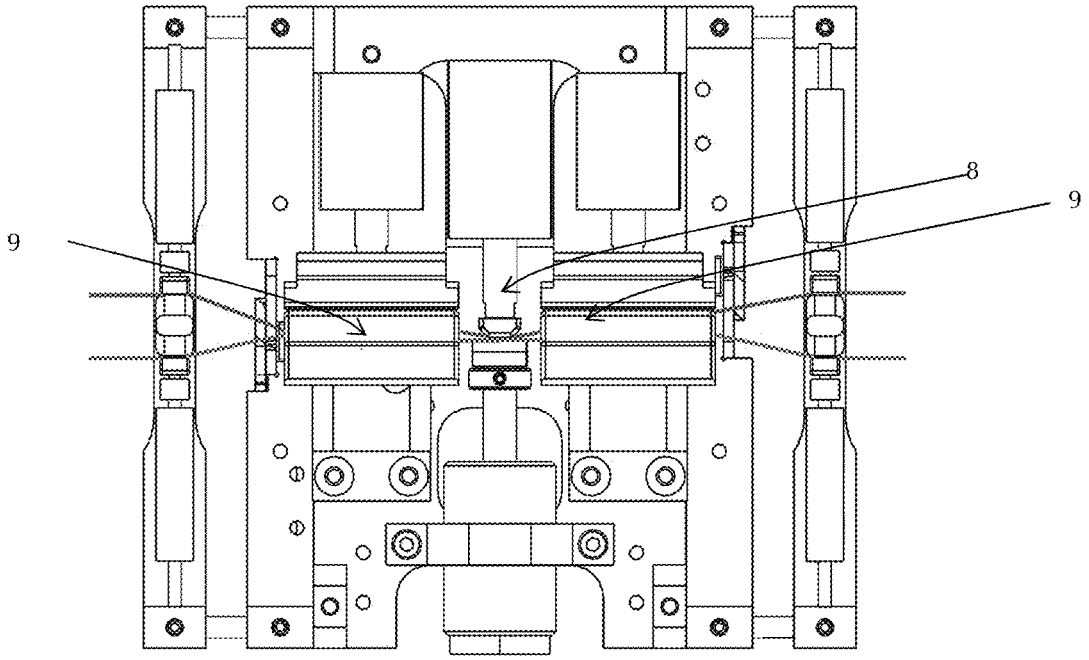

FIGS. 13*a* to 13*c* show a sequence of steps in which a pre-splice is performed. The illustration in FIGS. 13*a* and 13*b* corresponds to the illustration in FIGS. 4 and 5.

FIGS. 13*a* to 13*c* show additional intermediate steps to the process shown in FIGS. 4 to 7. Pre-splicing can be performed in these steps. After inserting and partially closing the splice clamps according to FIGS. 4 and 5, the yarn is drawn in by actuating the clamping device 8 (see FIG. 13*a*). Then the yarn is clamped by actuating the lateral clamping devices 9 (see FIG. 13*b*). Subsequently, the clamping device 8 is moved back so that there is an excess of yarn between the lateral clamping devices 9. In this position, the fluid supply is actuated for the first time so that a presplicing takes place. During this presplicing, the yarn ends are not yet cut. Subsequent to the presplicing according to FIG. 13*c*, the cutting of the ends, the drawing in of the yarn ends and the splicing take place as shown in FIGS. 6 and 7.

Instead of creating an excess of yarn by operating the clamping device 8, it is also possible to create an excess by moving the lateral clamping devices 9 towards each other (not shown, in analogy to the embodiment according to FIG. 10).

The invention claimed is:

1. A splicing head for a splicing device comprising a splicing chamber and a clamping device for clamping a first yarn and a second yarn, the clamping device being arranged between a first section and a second section of the splicing chamber, characterized in that the clamping device is arranged independently operable on the splicing head such that the clamping device is operable at least one of before and after closing the splicing chamber, wherein the splicing head comprises at least one drawing-in element for ensuring that a first yarn end of the first yarn and a second yarn end of the second yarn are arranged in the splicing chamber, wherein the splicing chamber is movably arranged on the splicing head so that the splicing chamber has at least one of the following features: chamber openings are closeable in a second position of the splicing chamber, and the splicing chamber has a closing device for closing the splicing chamber.

2. The splicing head according to claim 1, characterized in that the splicing head comprises two cutting elements for cutting the yarns.

3. The splicing head according to claim 2, wherein the cutting elements are arranged in a yarn guiding direction before the first and after the second section of the splicing chamber.

4. The splicing head according to claim 1, characterized in that the drawing-in element is designed such that a distance from an entrance opening for at least one of the first and second yarns into the splicing chamber sections to a clamping element of the clamping device is extended or extendable.

5. The splicing head according to claim 1, characterized in that the splicing chamber is at least one of extendable and displaceable.

6. The splicing head according to claim 5, characterized in that the splicing head comprises at least two further clamping devices being arranged in a yarn guiding direction before the first splicing chamber section and after the second splicing chamber section in the yarn guiding direction.

7. The splicing head according to claim 6, wherein at least one of the further clamping devices is at least one of rotatably arranged and displaceably arranged on the splicing head.

8. The splicing head according to claim 7, wherein the clamping device is displaceable in the yarn guiding direction.

9. The splicing head according to claim 5, wherein the splicing chamber sections are displaceable in a yarn guiding direction such that after displacement at least one yarn end is completely located in one of the splicing chamber sections.

10. The splicing head according to claim 1, characterized in that the clamping device comprises a first clamping element and a second clamping element, wherein the first clamping element comprises a first clamping surface and the second clamping element comprises a second clamping surface, wherein the clamping device defines a distance between the first clamping surface and second clamping surface in an open position, so that a tension can be applied to the first and second yarns when clamping the first and second yarns.

11. The splicing head according to claim 10, characterized in that the clamping surfaces comprise adhesive surfaces made of silicone for preventing sliding of the first and second yarns.

12. The splicing head according to claim 10, characterized in that the clamping device comprises at least one moving element of the group of a pneumatic, a hydraulic, and an electronic moving element for actuating at least one of the first clamping element and the second clamping element.

13. The splicing head according to claim 10, wherein the distance between the clamping surfaces in the open position is designed such that the first and second yarn ends can be retracted by at least 5% of a length of the splicing chamber.

14. A splicing device comprising a plurality of splicing heads according to claim 1.

15. The splicing device according to claim 14, wherein the splicing device comprises a computer unit.

16. A method for splicing yarn, with the splicing head according to claim 1, comprising the steps of a. introducing the first and second yarns to be spliced into the splicing chamber in such a way that the first and second yarn ends are located outside the splicing chamber, b. clamping the first and second yarns to be spliced with the clamping device, c. actuating the drawing-in element in such a way that the first and second yarn ends are located inside the splicing chamber, splicing the first and second yarn ends.

17. The method according to claim 16, comprising the further steps of a. before or after clamping the first and second yarns to be spliced with the clamping device, creating an excess of the first and second yarns between clamping points of the yarn in the clamping device, b. carrying out a presplicing operation, c. cutting the first and second yarn ends, d. operating the drawing-in element, e. carrying out the splicing.

18. A computing unit in communication with the splicing head of claim 1, the computing unit comprising a software component for performing at least one of the following steps: the actuation of the drawing-in element; and closing the splicing chamber.

19. The splicing head according to claim 1, wherein the drawing-in element for ensuring that the first and second yarn ends are arranged in the splicing chamber is configured for drawing the first and second yarn ends into the splicing chamber.

* * * * *